US006113434A

United States Patent [19]

Pate

[11] Patent Number: 6,113,434

[45] Date of Patent: Sep. 5, 2000

[54] OUTLET FOR ACCEPTING MULTIPLE ENLARGED PLUGS

[76] Inventor: D. Frank Pate, 7093 Susan Way, Salt Lake City, Utah 84121

[21] Appl. No.: 09/276,103

[22] Filed: Mar. 25, 1999

[51] Int. Cl.[7] ..... H01R 25/00

[52] U.S. Cl. ..... 439/652; 439/954; 439/535; 439/107; D13/137.1; D13/139.8

[58] Field of Search ..... 439/652, 535, 439/536, 650, 538, 544, 540.1, 373, 107, 954; 174/53, 58; D13/137.1, 138.2, 139.1, 139.8

[56] References Cited

U.S. PATENT DOCUMENTS

| | | | |
|---|---|---|---|
| D. 356,294 | 3/1995 | Fladung | D13/142 |
| D. 382,855 | 8/1997 | Salmond et al. | D13/139.8 |
| 4,504,103 | 3/1985 | Woedl | 439/535 |
| 4,867,701 | 9/1989 | Wiand | 439/652 |
| 4,930,047 | 5/1990 | Peterson | 439/535 |
| 4,993,970 | 2/1991 | Littrell | 439/535 |
| 5,109,316 | 4/1992 | Murphy | 439/535 |
| 5,135,411 | 8/1992 | Wiley et al. | 439/535 |
| 5,788,521 | 8/1998 | Milan | 439/652 |
| 5,967,815 | 10/1999 | Schlessinger et al. | 439/954 |

*Primary Examiner*—Gary F. Paumen
*Assistant Examiner*—Tho D. Ta

[57] ABSTRACT

A power receptacle system is provided for allowing the connection with an increased number of enlarged plugs. The system includes a housing with at least a pair of outlets mounted thereon having a pair of spaced and parallel rectangular slits and a semi-circular aperture. The outlets each have the semi-circular aperture thereof situated adjacent to a side opposite a side which the semi-circular aperture of an adjacent outlet is situated adjacent to. As such, the system allows a plug with an associated enlarged transformer to be plugged within each of the outlets.

4 Claims, 2 Drawing Sheets

OUTLET FOR ACCEPTING MULTIPLE ENLARGED PLUGS

BACKGROUND OF THE INVENTION

1. Field of the Invention

The present invention relates to outlets and more particularly pertains to a new outlet for accepting multiple enlarged plugs for allowing a plurality of transformer plugs to be plugged in an outlet assembly.

2. Description of the Prior Art

The use of outlets is known in the prior art. More specifically, outlets heretofore devised and utilized are known to consist basically of familiar, expected and obvious structural configurations, notwithstanding the myriad of designs encompassed by the crowded prior art which have been developed for the fulfillment of countless objectives and requirements.

Known prior art outlets include U.S. Pat. No. 4,598,968; U.S. Pat. No. 5,413,501; U.S. Pat. No. 4,249,789; U.S. Pat. No. 4,211,464; U.S. Pat. No. 4,283,102; and U.S. Pat. Des. 356,294.

In these respects, the outlet for accepting multiple enlarged lugs according to the present invention substantially departs from the conventional concepts and designs of the prior art, and in so doing provides an apparatus primarily developed for the purpose of allowing a plurality of transformer plugs to be plugged in an outlet assembly.

SUMMARY OF THE INVENTION

In view of the foregoing disadvantages inherent in the known types of outlets now present in the prior art, the present invention provides a new outlet for accepting multiple enlarged plugs construction wherein the same can be utilized for allowing a plurality of enlarged plugs to be plugged in a single outlet assembly.

The general purpose of the present invention, which will be described subsequently in greater detail, is to provide a new outlet for accepting multiple enlarged plugs apparatus and method which has many of the advantages of the outlets mentioned heretofore and many novel features that result in a new outlet for accepting multiple enlarged plugs which is not anticipated, rendered obvious, suggested, or even implied by any of the prior art outlets, either alone or in any combination thereof.

To attain this, the present invention generally comprises a power strip having a rectangular configuration with a planar rectangular top face, a planar rectangular bottom face and a thin periphery formed therebetween. As shown in FIG. 5, the periphery is defined by a pair of short end faces and a pair of elongated side faces. With continuing reference to FIG. 5, a plurality of outlets are mounted on the top face of the power strip along a length thereof. Each outlet has a pair of spaced and parallel rectangular slits and a semi-circular aperture. The outlets are each mounted in contiguous side-by-side relationship with the parallel rectangular strips of the outlets remaining in parallel relationship. It should be noted that a width of each outlet is equal to that of the top face of the power strip. As shown in the Figures, the semi-circular aperture of the outlets are situated adjacent to one of the side faces opposite the side face which the semi-circular aperture of an adjacent outlet is situated adjacent to. By this configuration, the outlets allow a plug with an associated enlarged transformer to be plugged within each of the outlets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outlet for accepting multiple enlarged plugs apparatus and method which has many of the advantages of the outlets mentioned heretofore and many novel features that result in a new outlet for accepting multiple enlarged plugs which is not anticipated, rendered obvious, suggested, or even implied by any of the prior art outlets, either alone or in any combination thereof.

It is another object of the present invention to provide a new outlet for accepting multiple enlarged plugs which may be easily and efficiently manufactured and marketed.

It is a further object of the present invention to provide a new outlet for accepting multiple enlarged plugs which is of a durable and reliable construction.

An even further object of the present invention is to provide a new outlet for accepting multiple enlarged plugs which is susceptible of a low cost of manufacture with regard to both materials and labor, and which accordingly is then susceptible of low prices of sale to the consuming public, thereby making such outlet for accepting multiple enlarged plugs economically available to the buying public.

Still yet another object of the present invention is to provide a new outlet for accepting multiple enlarged plugs which provides in the apparatuses and methods of the prior art some of the advantages thereof, while simultaneously overcoming some of the disadvantages normally associated therewith.

Still another object of the present invention is to provide a new outlet for accepting multiple enlarged plugs for allowing a plurality of enlarged plugs to be plugged in a single outlet assembly.

Even still another object of the present invention is to provide a new outlet for accepting multiple enlarged plugs that includes a housing with at least a pair of outlets mounted thereon having a pair of spaced and parallel rectangular slits and a semi-circular aperture. The outlets each have the semi-circular aperture thereof situated adjacent to a side opposite a side which the semi-circular aperture of an adjacent outlet is situated adjacent to. As such, the system allows a plug with an associated enlarged transformer to be plugged within each of the outlets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
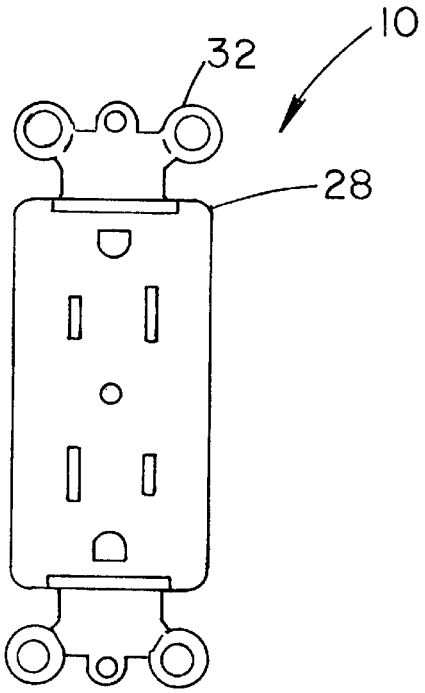
FIG. 1 is a front view of a new outlet for accepting multiple enlarged plugs according to the present invention.

With reference now to the drawings, and in particular to FIGS. 1 through 6 thereof, a new outlet for accepting multiple enlarged plugs embodying the principles and concepts of the present invention and generally designated by the reference numeral 10 will be described.

Figure 5:
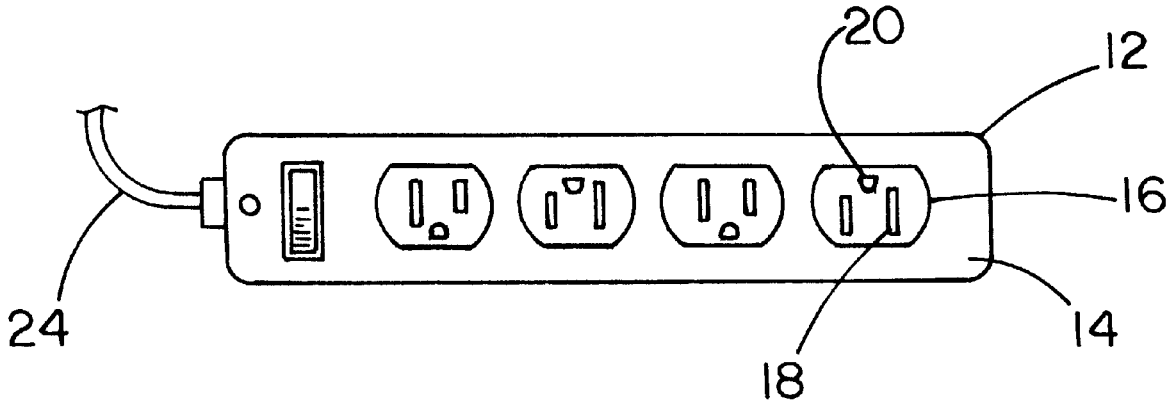
FIG. 5 is a top view of another embodiment of the present invention.

One of the embodiments of the present invention 10, shown in FIG. 5, includes a power strip 12 having a rectangular configuration with a planar rectangular top face 14, a planar rectangular bottom face and a thin periphery formed therebetween. As shown in FIG. 5, the periphery is defined by a pair of short end faces and a pair of elongated side faces.

With continuing reference to FIG. 5, a plurality of outlets 16 are mounted on the top face of the power strip along a length thereof. Each outlet has a pair of spaced and parallel rectangular slits 18 associated with hot and neutral connections of the outlet and a semi-circular aperture 20 associated with a ground connection of the outlet. The outlets are each mounted in contiguous side-by-side relationship with the parallel rectangular strips of the outlets remaining in parallel relationship. It should be noted that a width of each outlet of the present embodiment is equal to that of the top face of the power strip.

As shown in the FIG. 5, the semi-circular aperture of the outlets are situated adjacent to one of the side faces opposite the side face which the semi-circular aperture of an adjacent outlet is situated adjacent to. In other words, each outlet is rotated 180 degrees with respect to an adjacent outlet. By this configuration, the outlets allow a plug with an associated enlarged transformer to be plugged within each of the outlets.

Figure 4:
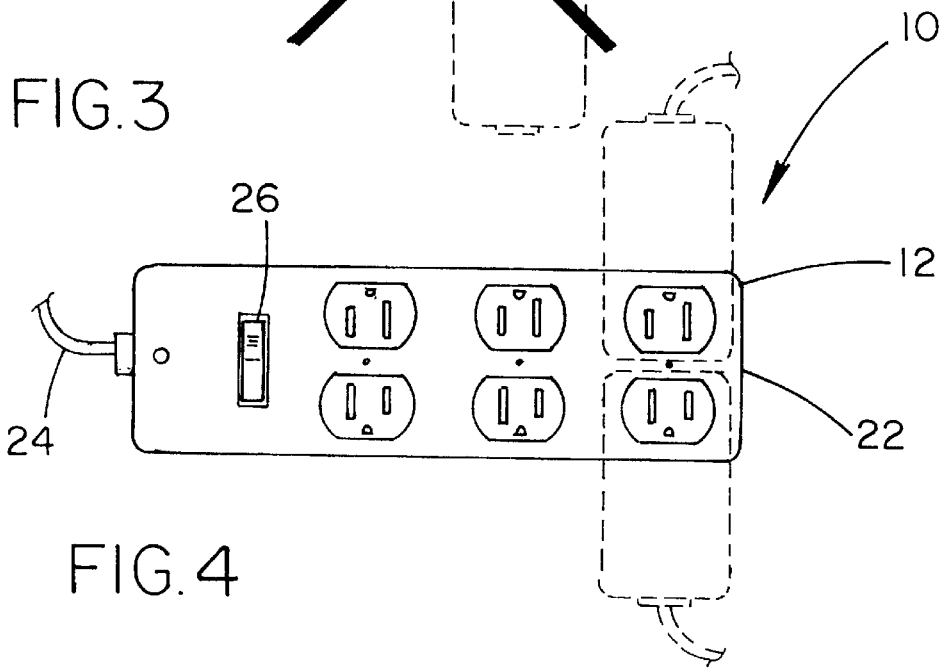
FIG. 4 is a top view of an alternate embodiment of the present invention.

In an alternate embodiment 22, the power strip is equipped with at least a doubled width. As shown in FIG. 4, a plurality of pairs of outlets are each situated between the side faces of the power strip. The outlets of such outlet pairs each have the semi-circular aperture thereof situated adjacent to one of the side faces opposite the side face which the semi-circular aperture of the associated outlet is situated adjacent to.

Further associated with the power strip is a power cord 24 coupled to one of the end faces of the power strip and connected to a conventional alternating current receptacle for receiving power therefrom. Mounted on the top face of the power strip is a toggle switch 26 which is connected between the power cord and each of the outlets for selectively supplying power thereto. A light indicates when power is available.

Figure 2:
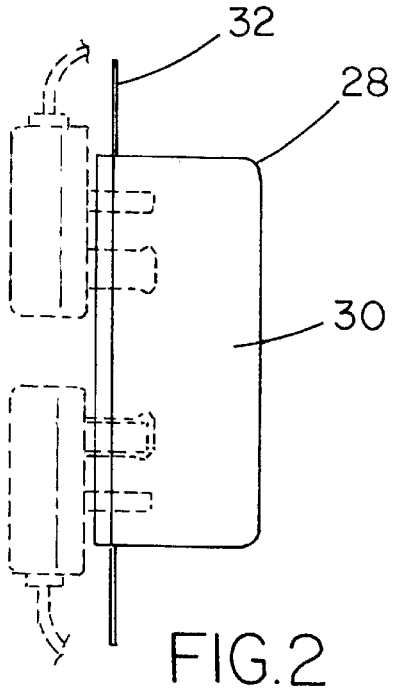
FIG. 2 is a side view of the present invention during use.
Figure 3:
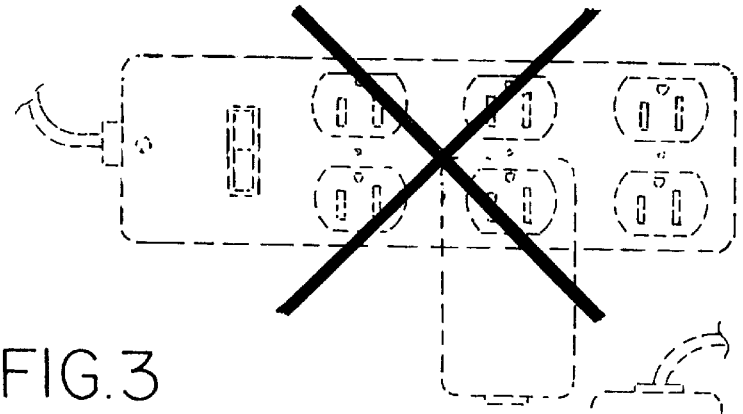
PRIOR ART FIG.3
FIG. 3 is a top view of a prior art device.

In yet another embodiment 28, shown in FIGS. 1 & 2, the power strip is replaced with a rectangular mount 30 with a pair eyelets 32 extending from both its lower and upper edges. A front face of the mount is equipped with a pair of outlets. The outlets of the mount each have the semi-circular aperture thereof situated adjacent to a side face of the mount opposite a side face which the semi-circular aperture of the other outlet is situated adjacent to. Further, in the present embodiment, the parallel rectangular slits include a large slit and a small slit. As shown in FIG. 1, the outlets each have the large slit thereof situated adjacent to the small slit of the adjacent outlet. In other words, the large slits of each of the outlets are diagonally situated. Preferably, the outlets of the present embodiment and those of FIG. 4 are spaced a distance equal to at least a width of one outlet.

Figure 6:
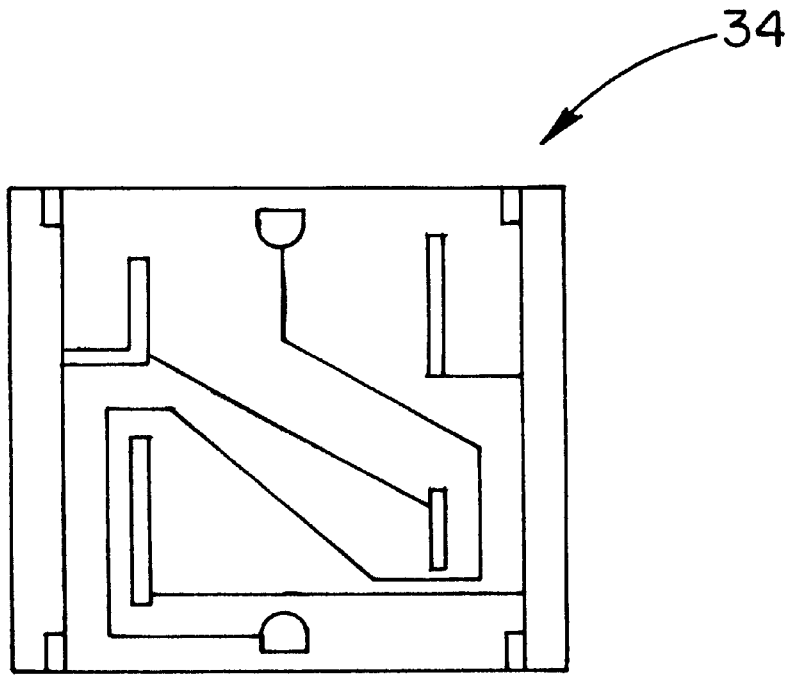
FIG. 6 is a schematic diagram of the present invention.

FIG. 6 shows a possible wiring schematic 34 which may be employed in the embodiments of FIGS. 1, 2, & 4. It should be noted that the wire connected between the semi-circular apertures may reside in a separate plane for affording more space between the remaining wires of the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A power receptacle system for removably receiving a plug having a base member and a pair of male blade terminals extending from the base member, the male blade terminals being oriented parallel to each other and each having a width, one of the male blade terminals having a width that is greater than a width of the other of the male blade terminals, and a ground lug extending parallel to the male blade terminals, the power receptacle system comprising:

a power strip having a rectangular configuration with a planar rectangular top face, a planar rectangular bottom face and a thin periphery formed therebetween defined by a pair of short end faces and a pair of elongated side faces including a first side face and a second side face;

a plurality of outlets mounted on the top face of the power strip along a length thereof, each outlet having a pair of spaced and parallel rectangular slits and an aperture, the slits of each outlet including a relatively large slit for accepting the male blade terminal having the greater width and a relatively small slit for accepting the male blade terminal having the smaller width, the outlets each being positioned in contiguous side-by-side relationship with the parallel rectangular slits of the other of the outlets mounted on the power strip and the slits of all of the outlets being in parallel relationship to each other, wherein the relatively small slits of adjacent outlets are positioned adjacent to each other and the relatively large slits of adjacent outlets are positioned adjacent to each other;

said outlets each having the aperture thereof situated adjacent to one of the side faces, wherein the aperture of each of the outlets is oriented adjacent to the first side face and the aperture of an adjacent outlet being oriented adjacent to the second side edge such that the apertures of the outlets alternate from the first side edge to the second side edge along the length of the power strip, whereby the outlets allow a plug with an associated enlarged transformer to be plugged within each of the outlets;

a power cord coupled to one of the end faces of the power strip for connection to a conventional alternating current receptacle for receiving power therefrom; and a toggle switch mounted on the top face of the power strip and connected between the power cord and each of the outlets for selectively supplying power thereto.

2. A power receptacle system for removably receiving a plug having a base member and a pair of male blade terminals extending from the base member, the male blade terminals being oriented parallel to each other and each having a width, one of the male blade terminals having a width that is greater than a width of the other of the male blade terminals, and a around lug extending parallel to the male blade terminals, the power receptacle system comprising:

a housing having a top face and first and second side faces; and a plurality of outlets mounted on the top face of the housing along a length thereof, each outlet having a pair of spaced and parallel rectangular slits and an aperture, the slits of each outlet including a relatively large slit for accepting the male blade terminal having the greater width and a relatively small slit for accepting the male blade terminal having the smaller width, the outlets each being positioned in contiguous side-by-side relationship with the parallel rectangular slits of the other of the outlets mounted on the housing and the slits of all of the outlets being in parallel relationship to each other wherein the relatively small slits of adjacent outlets are positioned adjacent to each other and the relatively large slits of adjacent outlets are positioned adjacent to each other;

said outlets each having the aperture thereof situated adjacent to one of the side faces, wherein the aperture of each of the outlets is oriented adjacent to the first side face and the aperture of an adjacent outlet being oriented adjacent to the second side edge such that the apertures of the outlets alternate from the first side edge to the second side edge along the length of the housing.

3. A power receptacle system as set forth in claim 2 wherein the housing includes a wall mount.

4. A power receptacle system as set forth in claim 2 wherein the housing includes a power strip.

* * * * *